US006913421B1

(12) United States Patent
Donahue

(10) Patent No.: US 6,913,421 B1
(45) Date of Patent: Jul. 5, 2005

(54) DIVING TANK POCKET BUOYANCY COMPENSATOR WITH ADJUSTABLE PRESSURE VALVE

(76) Inventor: Christopher A. Donahue, 925 S. Main Ave., Clermont, FL (US) 34711

( * ) Notice: Subject to any disclaimer, the term of this patent is extended or adjusted under 35 U.S.C. 154(b) by 0 days.

(21) Appl. No.: 10/762,612

(22) Filed: Jan. 21, 2004

(51) Int. Cl.[7] ..... B63C 11/02
(52) U.S. Cl. ..... 405/186; 220/62.18; 220/530
(58) Field of Search ..... 220/62.18, 62.2, 220/501, 529, 530; 405/185, 186

(56) References Cited

U.S. PATENT DOCUMENTS

| | | | | |
|---|---|---|---|---|
| 2,864,101 A | | 12/1958 | Kissenberger | 441/96 |
| 3,105,359 A | * | 10/1963 | Ellis | 405/186 |
| 3,964,266 A | * | 6/1976 | Bartlett | 405/186 |
| 3,998,304 A | | 12/1976 | Edgerton, Jr. et al. | 190/107 |
| 4,016,616 A | | 4/1977 | Walters | 405/186 |
| 4,054,132 A | * | 10/1977 | Deeds | 128/202.14 |
| 4,752,263 A | | 6/1988 | Pritchard et al. | 114/88 |
| 5,267,815 A | | 12/1993 | Feder | 405/186 |
| 5,620,282 A | | 4/1997 | Stinton | 405/186 |
| D391,368 S | * | 2/1998 | Hall | D24/110 |
| 5,902,073 A | | 5/1999 | Eungard et al. | 405/184 |
| 5,997,216 A | | 12/1999 | Kawashima | 405/186 |
| 6,120,213 A | | 9/2000 | Stinton | 405/186 |
| 6,183,164 B1 | * | 2/2001 | Canella | 405/186 |
| 6,354,295 B1 | | 3/2002 | Hasson, Jr. | 128/205.22 |
| 6,405,728 B1 | * | 6/2002 | Van Hall et al. | 128/205.22 |
| 6,592,298 B2 | | 7/2003 | Beltrani | 405/186 |

* cited by examiner

*Primary Examiner*—Thomas B. Will
*Assistant Examiner*—Tara L. Mayo
(74) *Attorney, Agent, or Firm*—The Livingston Firm; Edward M. Livingston; Angela M. Miller

(57) ABSTRACT

A diving-tank-pocket buoyancy compensator has an expandable diving-tank pocket (1) that envelopes a diving tank (2) which the diving-tank pocket is articulated for containing in addition to at least an inflated buoyancy air cell (3). The buoyancy air cell is in fluid communication with a cell end (4) of a buoyancy compensator (BC) tube (5) which has a tank end (6) in fluid communication with an inside periphery of the diving tank through a regulator tube (35) and a regulator valve (7) on the diving tank. An adjustable pressure valve (8, 38) intermediate the tank end and the cell end of the BC tube is provided to maintain a pre-determined pressure and resulting constant volume of air in the buoyancy air cell for maintaining a desired constant buoyancy.

40 Claims, 5 Drawing Sheets

FIG. 3
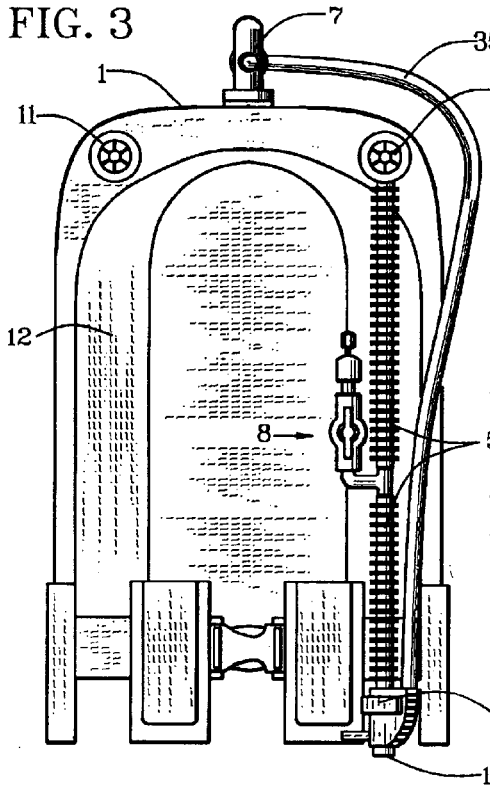
FIG. 4
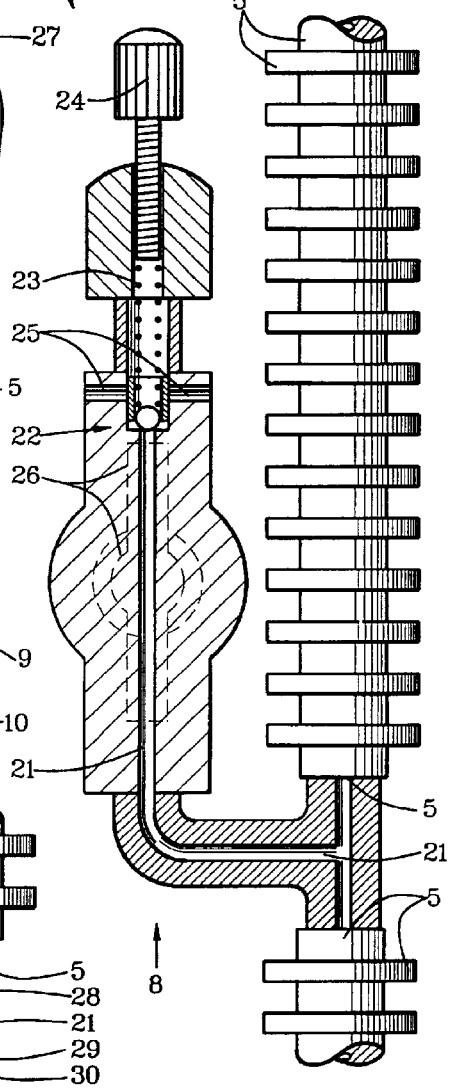
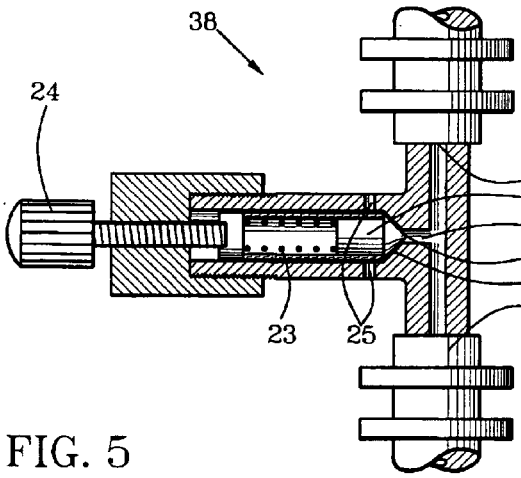
FIG. 5

FIG. 6
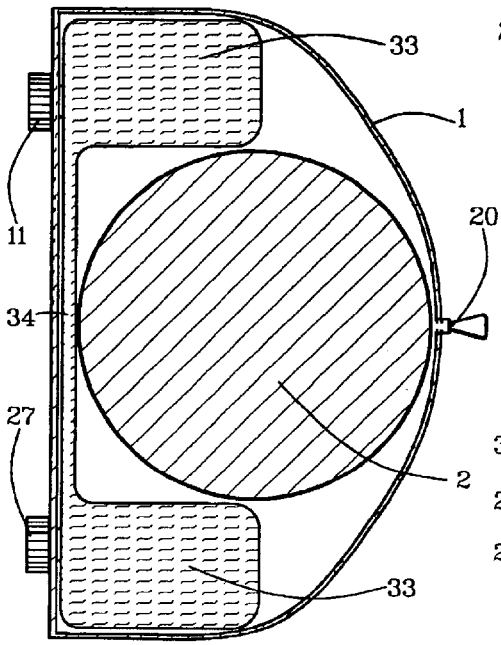
FIG. 7
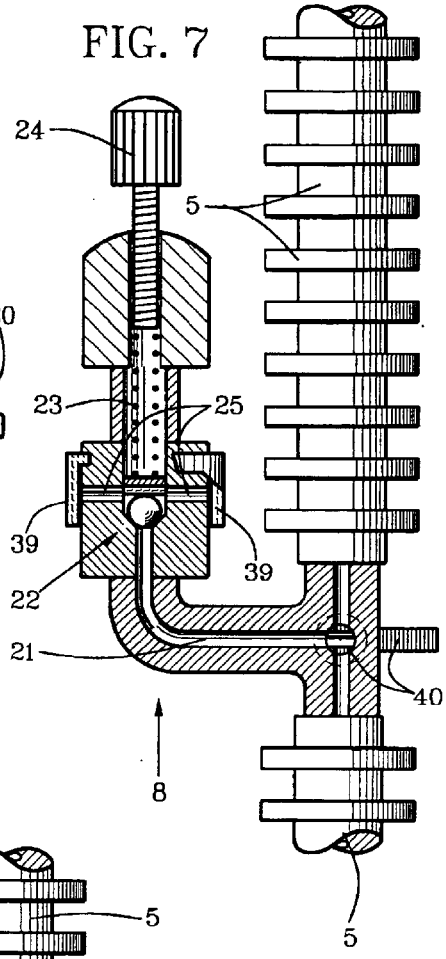
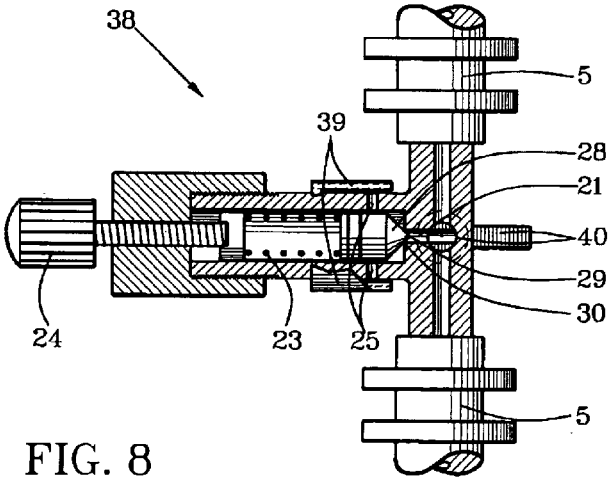
FIG. 8

DIVING TANK POCKET BUOYANCY COMPENSATOR WITH ADJUSTABLE PRESSURE VALVE

BACKGROUND OF THE INVENTION

This invention relates to buoyancy controlling and compensating devices (BCDs) for divers to control their depth in diving waters and their return to surface, and more particularly, to a BCD that envelopes a diving tank rather than the diver.

Known prior diving chutes have had diver-attachment portions that are inflatable with low-pressure air that is valve-released from high-pressure air in a diving tank for providing buoyancy. Some of the diver-attachment portions are included in belt-like and suspender-like structure of the diving chutes. Others include back air cells for receiving the low-pressure air for buoyancy control.

None are known, however, to have one or more inflatable air cells with automatically controllable air volume in a diving-tank pocket which is attached to a diving tank and a diving-chute harness in a manner taught by this invention.

The known related prior art includes the following references:

| U.S. Pat. No. | Inventor | Issue Date |
|---|---|---|
| 6,354,295 | Hasson, Jr. | Mar. 12, 2002 |
| 5,902,073 | Eungard, et al. | May 11, 1999 |
| 4,752,263 | Pritchard, et al. | Jun. 21, 1988 |
| 6,592,298 | Beltrani | Jul. 15, 2003 |
| 4,016,616 | Walters | Apr. 12, 1977 |
| 2,864,101 | Kissenberger | Dec. 16, 1958 |
| 3,998,304 | Edgerton, Jr., et al. | Dec. 21, 1976 |
| 5,267,815 | Feder | Dec. 07, 1993 |
| 5,620,282 | Stinton | Apr. 15, 1997 |
| 6,120,213 | Stinton | Sep. 19, 2000 |
| 5,997,216 | Kawashima | Dec. 07, 1999 |

SUMMARY OF THE INVENTION

Objects of patentable novelty and utility taught by this invention are to provide a diving-tank-pocket buoyancy compensator which:

- does not obstruct bodily movement;
- can be streamlined for low water resistance;
- can be adjusted linearly in relationship to a diving chute on a user's body for neutral buoyancy and attitude balance that allows convenient attitude control with movement of the user's body;
- can prevent over inflation by use of a novel pressure adjustment valve;
- can be attached to a selection of styles, sizes and shapes of diving chutes; and
- can be used for containing desired articles when the inflatable air cells are deflated.

This invention accomplishes these and other objectives with a diving-tank-pocket buoyancy compensator having an expandable diving-tank pocket that is articulated for containing a diving tank and at least one inflatable air cell. The buoyancy air cell is in fluid communication with a cell end of a buoyancy compensator (BC) tube which has a tank end in fluid communication with an inside periphery of a diving tank through a regulator tube in fluid communication with a regulator valve on the diving tank. An adjustable pressure valve intermediate the tank end and the cell end of the BC tube is provided to maintain a constant pressure and resulting constant volume of air in the buoyancy air cell for maintaining a desired constant buoyancy continuously following any change in air volume and pressure in the buoyancy air cell resulting from inlet of air through the BC tube and outlet of air through a tube-outlet valve in the BC tube and/or through a cell-relief valve in the air cell. The expandable diving-tank pocket and the diving tank are attachable to a predetermined diving-chute harness with at least one tank strap by positioning a pocket-attachment portion of the diving-tank pocket snugly intermediate a chute-attachment portion of the diving-chute harness and a tank-attachment portion of the diving tank. The tank strap is preferably metallic and has a screw-threaded adjustment buckle.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 3 is a front view of the FIG. 1 illustration;

FIG. 4 is a partially cutaway side view of an adjustable pressure valve on a BC tube;

FIG. 5 is a partially cutaway side view of a side-mount pressure valve on the BC tube;

FIG. 6 is a bottom view of a twin air cell in a diving-tank-pocket attached to a diving chute harness and to a diving tank;

FIG. 7 is a partially cutaway side view of an adjustable pressure valve having a resilient sleeve for restricting water entry;

FIG. 8 is a partially cutaway side view of a side-mount adjustable pressure valve having the resilient sleeve for restricting water entry;

DESCRIPTION OF PREFERRED EMBODIMENT

Figure 1:
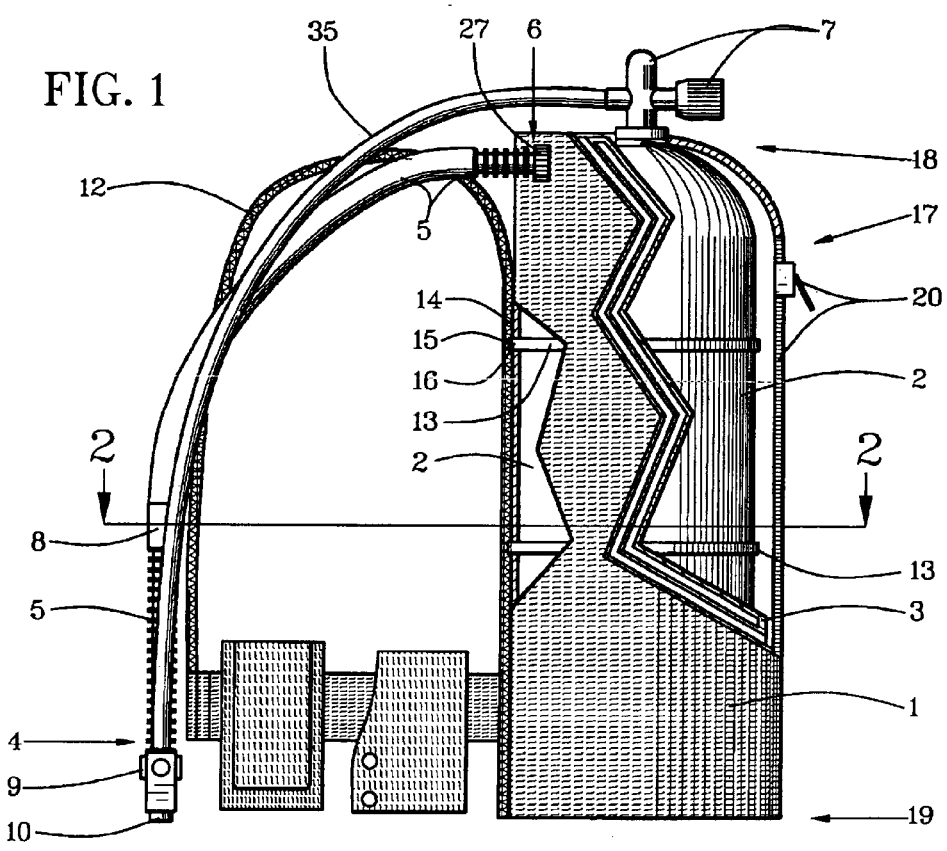
FIG. 1 is a partially cutaway side view of the expandable diving-tank-pocket buoyancy compensator attached to a diving chute harness and to a diving tank.

Listed numerically below with reference to the drawings are terms used to describe features of this invention. These terms and numbers assigned to them designate the same features throughout this description.

1. Diving-tank pocket/skin
2. Diving tank
3. Buoyancy air cell
4. Cell end
5. BC tube
6. Tank end
7. Regulator valve
8. Adjustable pressure valve
9. Inflation valve
10. Cell-outlet valve
11. Cell-relief valve
12. Diving-chute harness
13. Tank strap
14. Pocket-attachment portion
15. Chute-attachment portion
16. Tank-attachment portion
17. Pocket closer
18. Tank-top end
19. Tank-bottom end
20. Diving-adapted zipper
21. Control conveyance
22. Check valve
23. Adjustment spring
24. Adjustment knob
25. Overflow outlet
26. On-off switch
27. Air entry
28. Conical valve
29. Point portion
30. Valve seat
31. Conical shoulder portion
32. Envelope cell
33. Twin cells
34. Umbilical member
35. Regulator tube
36. Quick-release buckle
37. Tightness adjuster
38. Side-mount valve
39. Resilient sleeve
40. Bypass valve
41. Handle
42. End closer.

Figure 2:
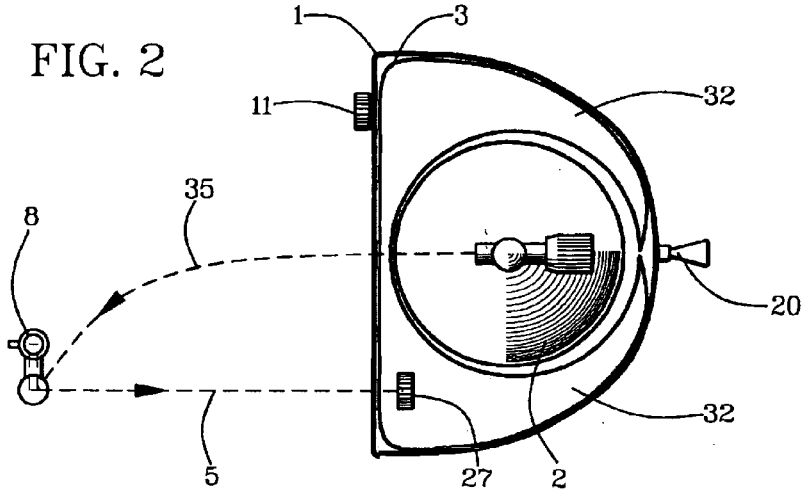
FIG. 2 is a section view taken through section line 1—1 of FIG. 1.

Referring to FIGS. 1–3, a diving-tank-pocket buoyancy compensator (BC) has an outer diving-tank pocket or skin (1) that is articulated for containing at least a diving tank (2) and an inflatable buoyancy air cell (3). The buoyancy air cell (3) is in fluid communication with a cell end (4) of a buoyancy compensator (BC) tube (5) which has a tank end (6) in fluid communication with an inside periphery of the diving tank (2) through a regulator valve (7) on the diving tank (2) and through a regulator tube (35) in fluid communication intermediate the regulator valve (7) on the diving tank (2) and the cell end (4) on the BC tube (5).

An adjustable pressure valve (8) intermediate the tank end (6) and the cell end (4) of the BC tube (5) is employed for maintaining a constant pressure and resulting constant volume of air in the buoyancy air cell (3) without overfill nor under-fill of the buoyancy air cell (3) and for thereby providing a desired constant buoyancy with volume of air in the buoyancy air cell (3). This is accomplished by adjusting for any change in volume and pressure in the buoyancy air cell (3) that may result from intentional inlet of air through an inflation valve (9) in the BC tube (5) and outlet of air through a cell-outlet valve (10) in the BC tube (5) and outlet of air through a cell-relief valve (11) in the buoyancy air cell (3) selectively. Change in volume and pressure of air in the buoyancy air cell (3) requiring adjustment with the adjustable pressure valve (8) might also occur from possible minor valve and air-cell leakage.

The diving tank (2) is attachable to a predetermined diving-chute harness (12) with at least one tank strap (13).

Figure 9:
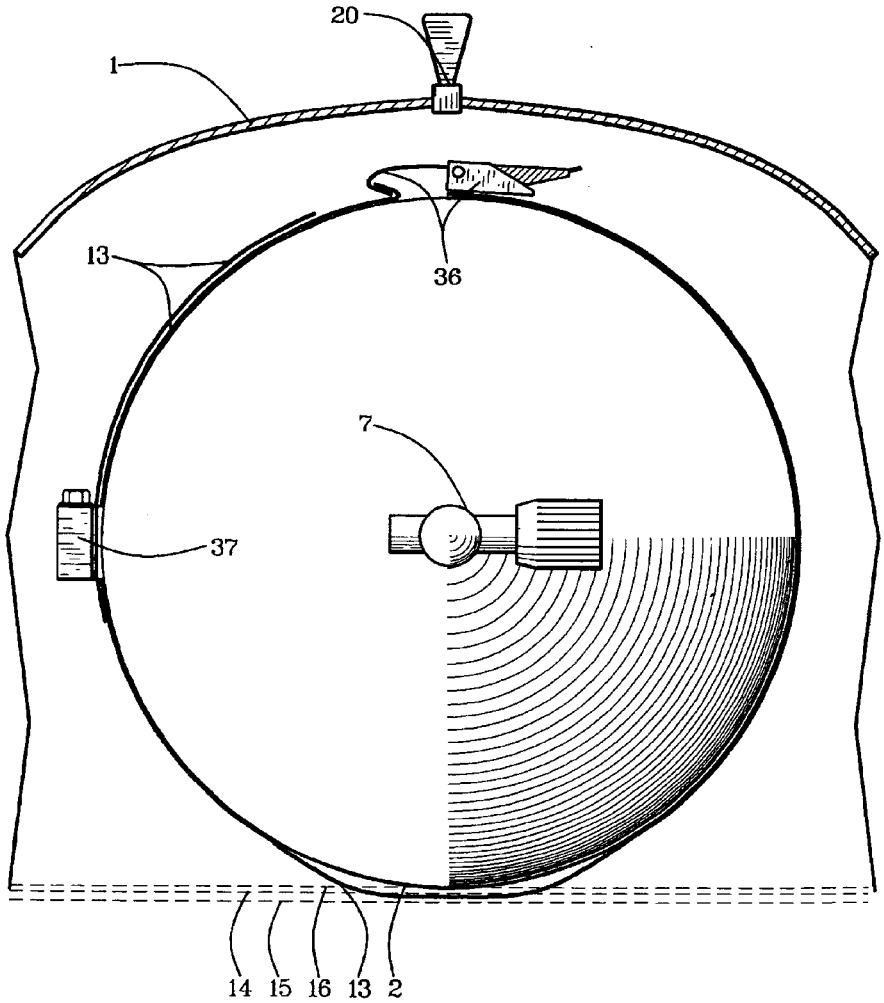
FIG. 9 is a partially cutaway top view of a tank strap in attachment relationship to a diving tank and a diving-tank pocket.
Figure 10:
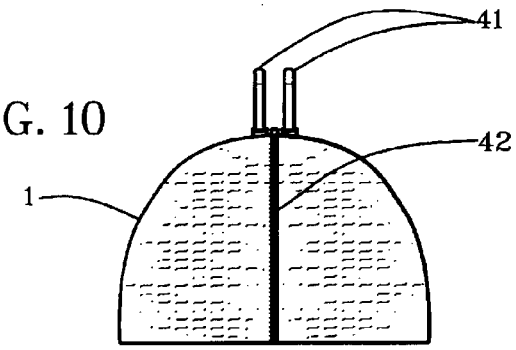
FIG. 10 is an end view of the diving-tank pocket that is usable as a diving bag independently of attachment to a diving tank and a diving chute.
Figure 11:
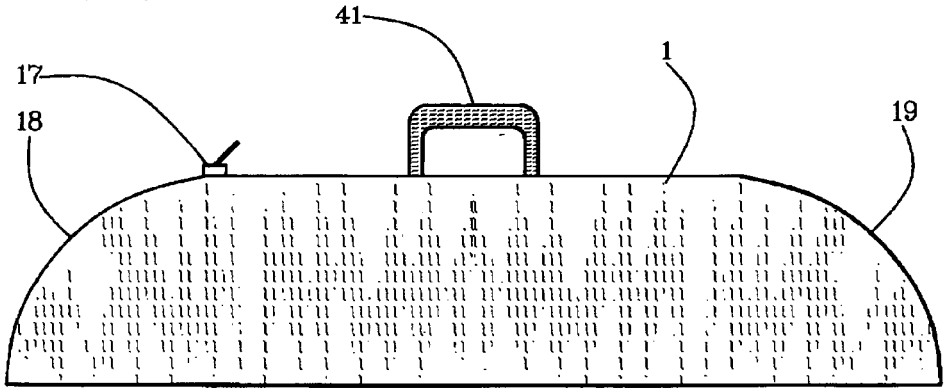
FIG. 11 is a side view of an embodiment of the diving-tank pocket for use as a diving bag and having arcuate ends.
Figure 12:
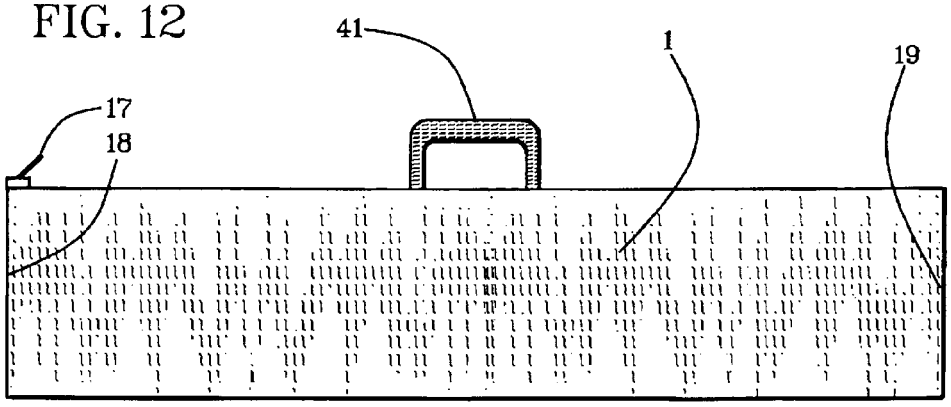
FIG. 12 is a side view of an embodiment of the diving-tank pocket for use as a diving bag and having orthogonal ends.

As shown in FIGS. 1 and 9, the expandable outer diving-tank pocket (1) can include a pocket-attachment portion (14) that is positioned intermediate a chute-attachment portion (15) of the diving-chute harness (12) and a tank-attachment portion (16) of the tank strap (13) for avoiding contact of the tank strap (13) with users.

The diving-tank pocket (1) can be closable with a pocket closer (17) intermediate a tank-top end (18) and tank-bottom end (19). The pocket closer (17) can include a diving-adapted zipper (20).

The diving-tank pocket (1) can include preferably a predeterminedly streamlined contour with the tank-top end (18) being predeterminedly arcuate.

The expandable diving-tank pocket (1) can include volumetric capacity for containing the buoyancy air cell (3) in an inflated mode in addition to containing the diving tank (2). The diving-tank pocket (1) also can include volumetric capacity for additional storage space.

The tank strap (13) can include a metallic strap that has a predeterminedly quick-release buckle (36). The tank strap (13) also can include a tightness adjuster (37) as shown in FIG. 9.

Referring to FIGS. 4–5 and 7–8, the adjustable pressure valve (8) includes a control conveyance (21) in fluid communication from the BC tube (5) to a check valve (22) that is adjustably spring-loaded with an adjustment spring (23) having tension adjustment with a screw-threaded adjustment knob (24) for allowing bypass of air selectively to an overflow outlet (25) for allowing excess air pressure to escape from the buoyancy air cell (3) controllably.

A water seal can be employed for restricting entry of water into the control conveyance (21) and thus into the BC tube (5). The water seal can include a resilient sleeve (39) that is articulated and positioned on the overflow outlet (25) as shown in FIGS. 7–8, for being pressured in closing contact with the overflow outlet (25) from water pressure when overflow air is not escaping through the overflow outlet (25).

An on-off switch (26) can be positioned in flow-control communication intermediate the control conveyance (21) and the overflow outlet (25) as shown in FIG. 4.

The check valve (22) of the adjustable pressure valve (8) is adjustable for preventing overfill of the buoyancy air cell (3) by adjusting spring pressure of the adjustment spring (23) for allowing escape of air through the overflow outlet (25) from pressure in excess of a maximum selected with the adjustment knob (24).

The adjustable pressure valve can include a side-mount valve (38) which has the control conveyance (21) in fluid communication from the BC tube (5) and has a conical valve (28) having a point portion (29) of the conical valve (28) positioned cyclically in contact with a valve seat (30) for valved air flow to the overflow outlet (25) as regulated with pressure of the adjustment spring (23) for allowing opening of the conical valve (28).

A water seal for restricting entry of water into the control conveyance (21) can be employed also for the side-mount valve (38). As shown in FIG. 8, the water seal can include the resilient sleeve (39) that is articulated and positioned on the overflow outlet (25) for being pressured into closing contact with the overflow outlet (25) from water pressure when overflow air is not escaping through the overflow outlet (25). Valve portions of the check valve (22) and of the side-mount valve (38) can be rubber or otherwise resiliency coated, as shown in FIGS. 4–5, to restrict entry of water when air is being released.

Connection means and tensile strength of the of the adjustable pressure valve (8) and for the side-mount valve (38) intermediate the cell end (4) and the tank end (6) of the BC tube (5) can be articulated with strength sufficient to allow jerking of any portion of the BC tube (5) for jerk-operation of an emergency-release valve proximate a BC-tube air entry (27) into the buoyancy air cell (3) for quick emergency dives to escape boat propellers and for other emergencies.

The diving-tank pocket (1) can include a generally cylindrical shape.

The diving-tank pocket (1) can include flexible structure with neoprene.

The buoyancy air cell (3) can include an envelope cell (32) that is wrapped onto the diving tank (2) as shown in FIG. 2.

Select forms of the buoyancy air cell (3) can be employed. As shown in FIG. 6, the buoyancy air cell (3) can include twin cells (33) that are positioned on opposite sides of the diving tank (2) and joined with an umbilical member (34) that is positioned adjacent to a predetermined portion of the diving tank (2). The umbilical member (34) includes structure for air conveyance for balancing air pressure and volume in the twin cells (33) when adding air to or releasing air from the twin cells (33).

As shown in FIGS. 7–8, a bypass valve (40) can be provided in the control conveyance (21) for allowing flow of air through the BC tube (5) without regulated escape through the adjustable pressure valve (8) selectively.

The side-mount valve (38) includes the control conveyance (21) in fluid communication from the BC tube (5) to the check valve (22) that is adjustably spring-loaded with the adjustment spring (23) having tension adjustment with the screw-threaded adjustment knob (24) for allowing bypass of air selectively to the overflow outlet (25). The check valve (22) for the side-mount valve (38) includes a conical valve (28) having a point portion (29) of the conical valve (28) positioned cyclically in a valve seat (30) proximate the overflow outlet (25) with pressure of the adjustment spring (23) for closing the check valve (22) and having a conical shoulder portion (31) of the conical valve (28) exposed to air pressure from the control conveyance (21) for forcing the conical valve (28) against pressure of the adjustment spring (23) for opening the check valve (22).

The expandable diving-tank pocket (1) can be arcuate at the tank-top end (18) and at the tank-bottom end (19) with an end closure (42) for use as a diving bag that is closable intermediate the tank-top end (18) and at the tank-bottom end (19) with the pocket closer (17). At least one handle (41) can be affixed to a top side for carrying the diving-tank pocket (1) and other diving gear independently of whether the diving tank (2) is attached internally to the diving-tank pocket (1).

The diving-tank pocket (1) can be orthogonal at the tank-top end (18) with the end closer (42) and at the tank-bottom end (19) with the end closer (42) for use as a diving bag that is closable intermediate the tank-top end (18) and at the tank-bottom end (19) with the pocket closer (17) for allowing access to the regulator valve (7) and for resting a bottom of the diving tank (2) directly on a surface selectively.

A new and useful diving-tank-pocket buoyancy compensator having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A diving-tank-pocket buoyancy compensator comprising:

a diving-tank pocket that is articulated for containing at least a diving tank and an inflatable buoyancy air cell;

the buoyancy air cell being in fluid communication with a cell end of a buoyancy compensator (BC) tube which has a tank end in fluid communication with an inside periphery of the diving tank through a regulator valve on the diving tank and through a regulator tube in fluid communication intermediate the regulator valve on the diving tank and the cell end on the BC tube;

a pressure valve intermediate the tank end and the cell end of the BC tube for maintaining a constant pressure and resulting constant volume of air in the buoyancy air cell without overfill of the buoyancy air cell and thereby for providing a desired constant buoyancy with volume of air in the buoyancy air cell by adjusting for any change in volume and pressure in the buoyancy air cell resulting from intentional inlet of air through an inflation valve in the BC tube and outlet of air through a cell-outlet valve in the BC tube and outlet of air through a cell-relief valve in the buoyancy air cell selectively and resulting also from possible minor valve and air-cell leakage;

and the diving tank being attachable to a predetermined diving-chute harness with at least one tank strap.

2. The diving-tank-pocket buoyancy compensator of claim 1 wherein:

the diving-tank pocket includes a pocket-attachment portion that is positioned intermediate a chute-attachment portion of the diving-chute harness and a tank-attachment portion of the tank strap for avoiding contact of the tank strap with users.

3. The diving-tank-pocket buoyancy compensator of claim 1 wherein:

the diving-tank pocket is closable with a pocket closer intermediate a tank-top end and tank-bottom end.

4. The diving-tank-pocket buoyancy compensator of claim 3 wherein:

the pocket closer includes a diving-adapted zipper.

5. The diving-tank-pocket buoyancy compensator of claim 1 wherein:

the diving-tank pocket includes a predeterminedly streamlined contour with the tank-top end being predeterminedly arcuate.

6. The diving-tank-pocket buoyancy compensator of claim 1 wherein:

the diving-tank pocket includes volumetric capacity for containing the buoyancy air cell in an inflated mode in addition to containing the diving tank.

7. The diving-tank-pocket buoyancy compensator of claim 1 wherein:

the diving-tank pocket includes volumetric capacity for containing the buoyancy air cell in an inflated mode and the diving tank in addition to having additional storage space.

8. The diving-tank-pocket buoyancy compensator of claim 1 wherein:

the tank strap includes a metallic strap and has a predeterminedly quick-release buckle.

9. The diving-tank-pocket buoyancy compensator of claim 8 wherein:

the tank strap includes a tightness adjuster.

10. The diving-tank-pocket buoyancy compensator of claim 9 wherein:

the check valve of the pressure valve is adjustable for preventing overfill of the buoyancy air cell by adjusting spring pressure of the adjustment spring for allowing escape of air through the overflow outlet from pressure in excess of a maximum selected with the adjustment knob.

11. The diving-tank-pocket buoyancy compensator of claim 1 wherein:

the pressure valve includes a control conveyance in fluid communication from the BC tube to a check valve that is adjustably spring-loaded with an adjustment spring having tension adjustment with a screw-threaded adjustment knob for allowing bypass of air selectively to an overflow outlet for allowing excess air pressure to escape from the buoyancy air cell controllably.

12. The diving-tank-pocket buoyancy compensator of claim 11 and further comprising:

a water seal for restricting entry of water into the control conveyance.

13. The diving-tank-pocket buoyancy compensator of claim 12 wherein:

the water seal includes a resilient sleeve that is articulated and positioned on the overflow outlet for being pressured in closing contact with the overflow outlet from water pressure when overflow air is not escaping through the overflow outlet.

14. The diving-tank-pocket buoyancy compensator of claim 11 and further comprising:

an on-off switch positioned in flow-control communication intermediate the control conveyance and the overflow outlet.

15. The diving-tank-pocket buoyancy compensator of claim 11 wherein:

connection means and tensile strength of the of the pressure valve intermediate the cell end and the tank end of the BC tube are articulated with strength sufficient to allow jerking of any portion of the BC tube for jerk-operation of an emergency-release valve proximate a BC-tube air entry into the buoyancy air cell for quick emergency dives to escape boat propellers and other emergencies.

16. The diving-tank-pocket buoyancy compensator of claim 1 wherein:

the pressure valve includes a side-mount valve;

the side-mount valve includes the control conveyance in fluid communication from the BC tube;

the check valve for the side-mount valve includes a conical valve having a point portion of the conical valve positioned cyclically in contact with a valve seat for valved air flow to the overflow outlet as regulated with pressure of the adjustment spring for allowing opening of the conical valve.

17. The diving-tank-pocket buoyancy compensator of claim 16 and further comprising:

a water seal for restricting entry of water into the control conveyance.

18. The diving-tank-pocket buoyancy compensator of claim 17 wherein:

the water seal includes a resilient sleeve that is articulated and positioned on the overflow outlet for being pressured in closing contact with the overflow outlet from water pressure when overflow air is not escaping through the overflow outlet.

19. The diving-tank-pocket buoyancy compensator of claim 16 wherein:

connection means and tensile strength of the of the side-mount valve intermediate the cell end and the tank end of the buoyancy compensator (BC) tube are articulated with strength sufficient to allow jerking of any portion of the BC tube for jerk-operation of an emergency-release valve proximate a BC-tube air entry into the buoyancy air cell for quick emergency dives to escape boat propellers and other emergencies.

20. The diving-tank-pocket buoyancy compensator of claim 1 wherein:

the diving-tank pocket includes a generally cylindrical shape.

21. The diving-tank-pocket buoyancy compensator of claim 1 wherein:

the diving-tank pocket includes flexible structure with neoprene.

22. The diving-tank-pocket buoyancy compensator of claim 1 wherein:

the buoyancy air cell includes an envelope cell that is wrapped onto the diving tank.

23. The diving-tank-pocket buoyancy compensator of claim 1 wherein:

the buoyancy air cell includes twin cells that are positioned on opposite sides of the diving tank and joined with an umbilical member; and the umbilical member is positioned adjacent to a predetermined portion of the diving tank.

24. The diving-tank-pocket buoyancy compensator of claim 23 wherein:

the umbilical member includes structure for air conveyance for balancing air pressure and volume in the twin cells when adding air to or releasing air from the twin cells.

25. A diving-tank-pocket buoyancy compensator comprising:

a diving-tank pocket having an internal portion that is attachable to a diving tank which the diving-tank pocket is articulated for containing an inflatable buoyancy air cell in an inflated mode, wherein the buoyancy air cell is in fluid communication with a cell end of a BC tube which has a tank end in fluid communication with an inside periphery of the diving tank through a regulator tube and a regulator valve on the diving tank;

the diving-tank pocket being attachable to a diving chute harness; and a pressure valve intermediate the tank end and the cell end of the BC tube for maintaining a constant pressure and resulting constant volume of air in the buoyancy air cell to provide a desired constant buoyancy and overfill with volume of air in the buoyancy air cell.

26. The diving-tank-pocket buoyancy compensator of claim 25 wherein:

the pressure valve includes a control conveyance in fluid communication from the BC tube to a check valve that is adjustably spring-loaded with an adjustment spring having tension adjustment with a screw-threaded adjustment knob for allowing bypass of air selectively to an overflow outlet;

the check valve of the pressure valve is adjustable for preventing overfill of the buoyancy air cell by adjusting spring pressure of the adjustment spring for allowing bypass of air with pressure in excess of a selected maximum with the adjustment knob.

27. The diving-tank-pocket buoyancy compensator of claim 26 and further comprising:

a water seal for restricting entry of water into the control conveyance.

28. The diving-tank-pocket buoyancy compensator of claim 27 wherein:

the water seal includes a resilient sleeve that is articulated and positioned on the overflow outlet for being pressured in closing contact with the overflow outlet from water pressure when overflow air is not escaping through the overflow outlet.

29. The diving-tank-pocket buoyancy compensator of claim 28 and further comprising:

a bypass valve in the control conveyance for allowing flow of air through the BC tube without regulated escape through the pressure valve selectively.

30. The diving-tank-pocket buoyancy compensator of claim 29 wherein:

the diving-tank pocket is closable with a pocket closer intermediate a tank-top end and tank-bottom end;

the pocket closer includes a diving-adapted zipper;

the diving-tank pocket includes a predeterminedly streamlined contour with the tank-top end being predeterminedly arcuate; and the diving-tank pocket includes volumetric capacity for containing the buoyancy air cell in an inflated mode in addition to containing the diving tank.

31. The diving-tank-pocket buoyancy compensator of claim 26 wherein:

the pressure valve includes a side-mount valve;

the side-mount valve includes the control conveyance in fluid communication from the BC tube to the check valve that is adjustably spring-loaded with the adjustment spring having tension adjustment with the screw-threaded adjustment knob for allowing bypass of air selectively to the overflow outlet;

the check valve for the side-mount valve includes a conical valve having a point portion of the conical valve positioned cyclically in a valve seat to the overflow outlet with pressure of the adjustment spring for closing the check valve and having a conical shoulder portion of the conical valve exposed to air pressure from the control conveyance for forcing the conical valve against pressure of the adjustment spring for opening the check valve.

32. The diving-tank-pocket buoyancy compensator of claim 31 and further comprising:

a water seal for restricting entry of water into the control conveyance.

33. The diving-tank-pocket buoyancy compensator of claim 32 wherein:

the water seal includes a resilient sleeve that is articulated and positioned on the overflow outlet for being pressured in closing contact with the overflow outlet from water pressure when overflow air is not escaping through the overflow outlet.

34. The diving-tank-pocket buoyancy compensator of claim 33 and further comprising:

a bypass valve in the control conveyance for allowing flow of air through the BC tube without regulated escape through the pressure valve selectively.

35. The diving-tank-pocket buoyancy compensator of claim 34 wherein:

the check valve for the pressure valve includes a conical valve having a point portion of the conical valve positioned cyclically in the valve seat to the overflow outlet with pressure of the adjustment spring for closing the check valve and having a conical shoulder portion of the conical valve exposed to air pressure from the control conveyance for forcing the conical valve against pressure of the adjustment spring for opening the check valve.

36. The diving-tank-pocket buoyancy compensator of claim 35 wherein:

the pressure valve is positioned and is oriented predeterminedly in relationship to the BC tube for being readily accessible for finger rotation of the adjustment knob.

37. The diving-tank-pocket buoyancy compensator of claim 31 wherein:

the pressure valve is positioned and is oriented predeterminedly in relationship to the BC tube for being readily accessible for finger rotation of the adjustment knob.

38. The diving-tank-pocket buoyancy compensator of claim 26 wherein:

the pressure valve is positioned and is oriented predeterminedly in relationship to the BC tube for being readily accessible for finger rotation of the adjustment knob.

39. A diving-tank-pocket buoyancy compensator of comprising:

a diving-tank pocket having an internal portion that is attachable to a diving tank which the diving-tank pocket is articulated for containing an inflatable buoyancy air cell in an inflated mode;

the diving-tank pocket being attachable to a diving-chute harness; and the diving-tank pocket is arcuate at the tank-top end and at the tank-bottom end with an end closer for use as a diving bag that is closable intermediate the tank-top end and at the tank-bottom end with a pocket closer; and at least one handle is affixed to a top side for carrying the diving-tank pocket and other diving gear independently of whether the diving tank is attached internally to the diving-tank pocket.

40. A diving-tank-pocket buoyancy compensator comprising:

a diving-tank pocket having an internal portion that is attachable to a diving tank which the diving-tank pocket is articulated for containing an inflatable buoyancy air cell in an inflated mode;

the diving-tank pocket being attachable to a diving-chute harness; and the diving-tank pocket is orthogonal at the tank-top end and at the tank-bottom end with an end closer for use as a diving bag that is closable intermediate the tank-top end and at the tank-bottom end with a pocket closer; and at least the one handle is affixed to the top side for carrying the diving-tank pocket and other diving gear independently of whether the diving tank is attached internally to the diving-tank pocket.

* * * * *